US005538143A

United States Patent [19]

Pettersson

[11] Patent Number: 5,538,143

[45] Date of Patent: Jul. 23, 1996

[54] APPARATUS FOR SEPARATING CUTLERY FROM FOOD SCRAPS

[75] Inventor: Tord Pettersson, Enebyberg, Sweden

[73] Assignees: Bjorn Bygge; Jan Hellman, both of Switzerland

[21] Appl. No.: 325,459

[22] PCT Filed: Apr. 29, 1993

[86] PCT No.: PCT/SE93/00381

§ 371 Date: Oct. 28, 1994

§ 102(e) Date: Oct. 28, 1994

[87] PCT Pub. No.: WO93/22075

PCT Pub. Date: Nov. 11, 1993

[30] Foreign Application Priority Data

Apr. 29, 1992 [SE] Sweden ..... 9201357

[51] Int. Cl.[6] ..... B07C 9/00

[52] U.S. Cl. ..... 209/698; 209/926; 209/941

[58] Field of Search ..... 209/698, 911, 209/926, 941, 606

[56] References Cited

U.S. PATENT DOCUMENTS 3,289,832 12/1966 Ramsay ..... 209/698 X 4,161,251 7/1979 Paul ..... 209/941 X

FOREIGN PATENT DOCUMENTS 0148139 7/1985 European Pat. Off. .

2610272 9/1977 Germany ..... 209/926

3618173 12/1987 Germany ..... 209/698

8500123 1/1985 WIPO .

8800501 1/1988 WIPO .

*Primary Examiner*—William E. Terrell

*Assistant Examiner*—Tuan Nguyen

*Attorney, Agent, or Firm*—Ostrolenk, Faber, Gerb & Soffen

[57] ABSTRACT

An apparatus for separating cutlery from food waste, such as for use in a restaurant, includes a glacis which is angled toward the opening of a waste container. Extending from an end of the glacis are a set of flaps having a closed position whereby they guide the food waste into the waste container, and having an open position whereby they separate and expose a receptacle for receiving cutlery. A detector is disposed relative to the glacis for detecting a cutlery item inadvertently mixed with the food waste on the glacis. If a cutlery item is sensed by the detector, the flaps are caused to open and the cutlery item falls into the cutlery receptacle, thereby the cutlery is separated from the food waste.

3 Claims, 2 Drawing Sheets

Fig. 3
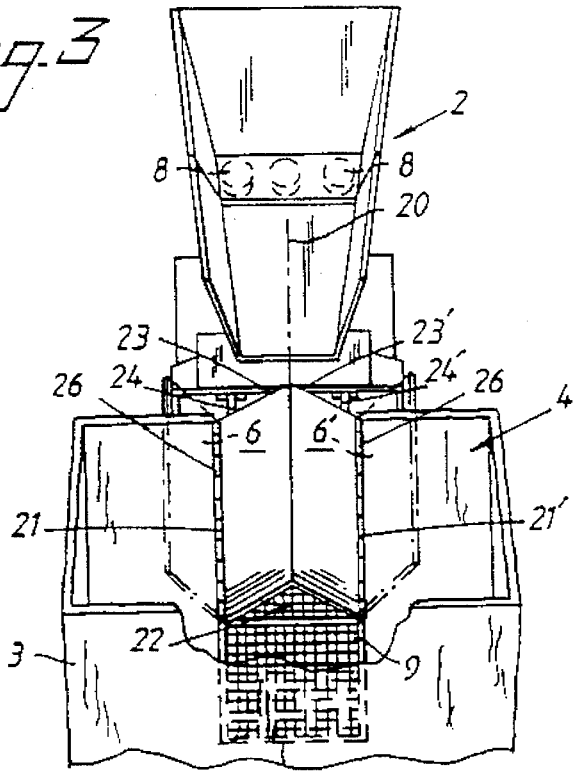
Fig. 5
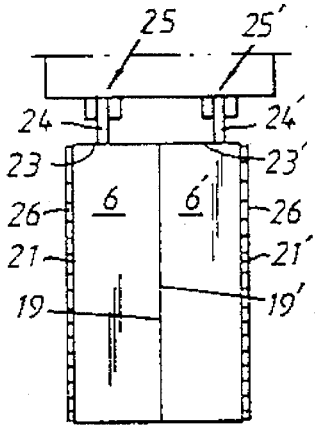
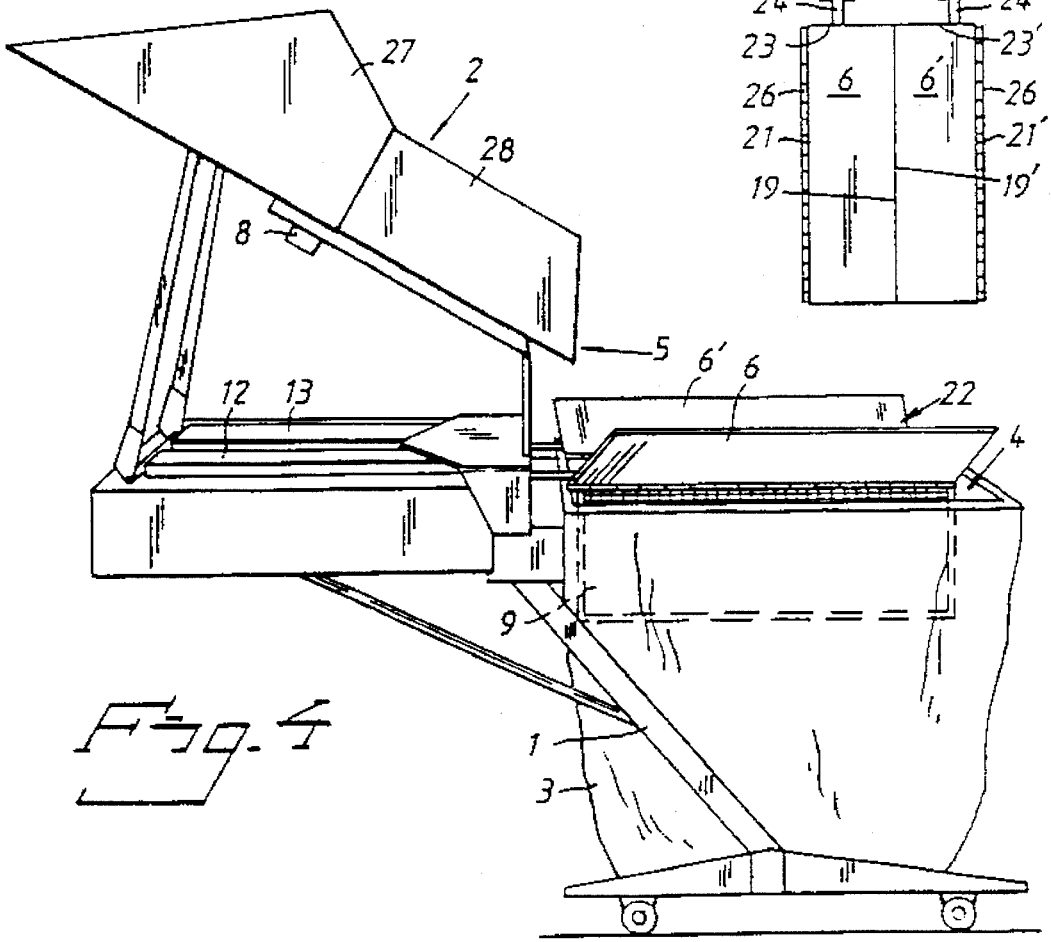
Fig. 4

APPARATUS FOR SEPARATING CUTLERY FROM FOOD SCRAPS

BACKGROUND OF THE INVENTION

The present invention relates to an apparatus for separating cutlery from restaurant waste, the apparatus including a glacis collecting the waste which slides on it together with any cutlery in a direction towards the opening of a waste container, which is supported by a stand, implemented such that the glacis is preferably positionally adjustable at the container, there being at least two flaps, movable between end positions such as to enable separation of cutlery and the prevention of these items from coming into the container, as well as at least one detector arranged at the glacis before the flaps in the sliding direction of the waste, for sending a signal when an item of cutlery passes over it, the signal controlling a drive means for causing movement of the flaps between their end positions.

An apparatus for separating cutlery from restaurant waste is already known, where the waste containing cutlery is accumulated in a special hopper, before the waste is fed further downwards into a waste container, the operator scraping off the waste from plates and the like having to put his hand into the waste to retrieve the cutlery thus trapped. This is, of course, not regarded favorably by persons cleaning off the dishes before they are washed. In many cases it has therefore been found that cutlery retrieval has been neglected, these items being lost in spite of the measures taken. From studies made in restaurant kitchens in hotels it has been found that not just one or two items, but large amounts of cutlery are lost in this way, particularly when the restaurant has many customers and the waiters are flurried, cutlery being tipped together with waste into the waste container, although special arrangements have been made to catch or arrest and search the waste, which could contain cutlery, since it is always unpleasant for personnel to retrieve the cutlery, particularly in rush-hour conditions.

SUMMARY OF THE INVENTION

The object of the present invention is to provide an apparatus of the kind mentioned in the introduction for separating cutlery from waste, werewith the problems mentioned above are eliminated. The distinguishing features of the invention are disclosed in the accompanying claims.

As a result of the present invention there has now been achieved an apparatus, with the aid of which cutlery unintentionally tipped away with waste from a plate or the like can be readily dealt with. The cutlery which has been separated from the waste and retrieved is namely collected in a separate cutlery collection receptacle, suitably formed with interstices, through which any food residue adhering to the cutlery may be flushed away. The cutlery can then be put in the restaurant dish washer in the usual way.

The invention is described in more detail hereinafter, with the aid of some embodiment examples and with reference to the accompanying drawings, where

BRIEF DESCRIPTION OF THE DRAWINGS

FIG. 3 is a schematic, perspective view of a second embodiment of the apparatus in accordance with the invention, where cutlery is sorted out with the aid of two flaps, which are movable between end positions, and are pivotably mounted on hinges over a cutlery collection receptacle, these flaps being shown in their closed positions, FIG. 4 is a schematic, perspective view of the apparatus illustrated in FIG. 3, but more in side view, and where the flaps are in their parted, open positions and FIG. 5 is a plan view of a part of the apparatus illustrated in FIGS. 4 and 5.

DETAILED DESCRIPTION OF THE INVENTION

Figure 1:
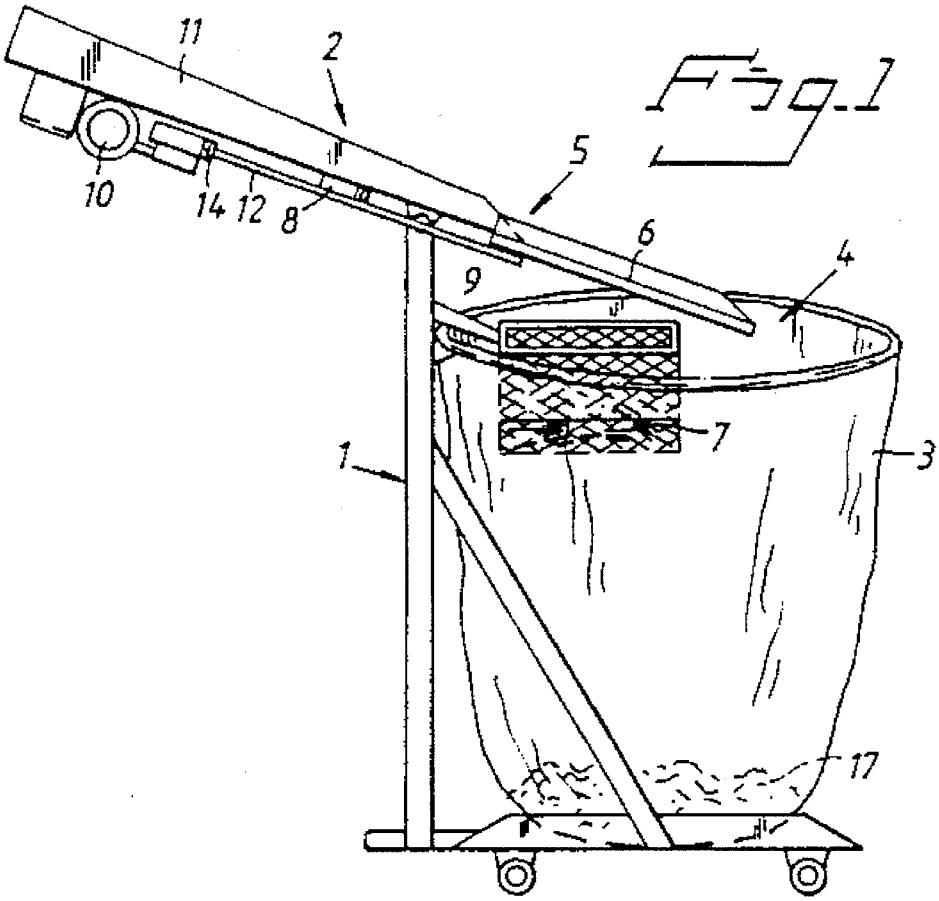
FIG. 1 is a schematic, perspective view of a first embodiment of an apparatus in accordance with the present invention for separating cutlery from restaurant waste.
Figure 2:
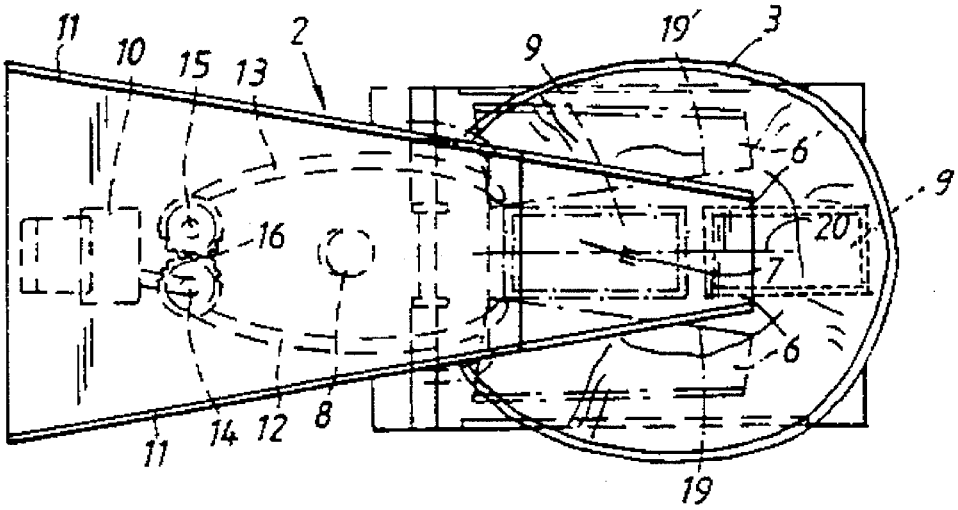
FIG. 2 is a schematic view from above of the apparatus illustrated in FIG. 1.

Referring to FIGS. 1 and 2, a first, preferred embodiment of the inventive apparatus includes a stand 1, there being a glacis 2 arranged at its upper end. The glacis 2 is adjustable for obtaining a suitable incline, and is made from stainless steel or plastics with a smooth upper side, thus enabling the waste 17, that has been scraped off plates and the like, such as to fall onto the glacis, to slide with practically no friction down into a waste container 3, also attached to the stand 1. The container 3 has its opening 4 situated below the end 5 of the glacis 2. In addition, the apparatus includes, in this embodiment of the invention, two flaps 6, 6' which can be swung between two end positions in directions towards, and away from each other. In their first closed positions, their opposing end edges 19, 19' meet along an axis 20 of symmetry in the longitudinal direction of the glacis 2. From this axis the flaps 6, 6' may be swung outwards and into their second, open, end positions. The flaps 6, 6' have their hinges at, or immediately under the end 5 of the glacis 2, so that in their first end positions, with their end edges 19, 19' juxtaposed, they form a continuation of the glacis 2, and in their second end positions, when the flaps 6, 6' are mutually spaced, they no longer form part of the glacis 2, which is then shorter. The flaps 6, 6' take up their second end positions when a cutlery item 7 present in the waste 17 that is emptied on to the glacis 2 and is sensed by at least one detector 8 placed under the glacis before its free end 5. The cutlery item 7 is then discharged from the glacis 2, past the open flaps, directly down into a separate cutlery collection receptacle 9. In this example, the receptacle 9 is arranged inside the waste container 3 and under the flaps 6, 6'. The cutlery receptacle 9 is suitably implemented as a waste basket made from stainless steel or a suitable plastics material, so that any food residue may be easily flushed away before the collected cutlery is taken out. Alternatively, the flaps 6, 6' may be open in their first, or normal positions. In this case the waste 17 is then emptied directly from the glacis 2 down into the waste container 3. In their second, closed positions, the flaps 6, 6' in this case form a continuation of the glacis 2, for enabling discharge of one or more cutlery items, sensed by the detector, into the receptacle 9, which is here suitably arranged in the container 3 for receiving them, and is illustrated by dashed lines in FIG. 2.

The detector 8, which may be placed under the glacis 2, before its free end 5, is of a conventional type for detecting both magnetic and non-magnetic items, and thereby capable of detecting the passage of cutlery items 7 made from stainless steel, aluminium or alpacka. In certain cases, however, it can be calibrated so that such as so-called silver paper, bottle caps etc passing over it do not activate the signal it sends to a drive means 10, which may be of a kind such as the low-voltage motor used for driving windscreen wipers in cars, this motor actuating the mutually relative movement of the flaps 6, 6'.

The glacis 2, extending in a direction towards and somewhat above the waste container opening 4, forms a plane, which can be adjusted to a suitable inclination, and tapers, as seen from above, in a direction towards its free end 5. It is also provided with edge portions 11 for guiding waste 17 towards the end 5, from whence the waste is discharged past the flaps 6, 6' into the waste container 3.

In accordance with the embodiment illustrated in FIGS. 1 and 2, the flaps 6, 6' are each fastened to its respective arm 12, 13, which has an arcuate extension about the detector 8. The arms 12, 13, and thus the flaps 6, 6', are pivotable about journalling pins 14, 15 under the glacis 2, and they coact synchronously via meshing teeth 16. When a cutlery item 7 is sensed in the waste 17 emptied on to the glacis 2, the detector 8 sends a signal to the drive means 10, which is connected by an unillustrated coupling to one arm 12 via the pin 14, for turning the arms 12, 13 and their associated flaps 6, 6' to a second, open end position. The open position of the flaps 6, 6' and their associated arms 12, 13 is maintained by a timing clock (not illustrated on the drawing) for a selectable time period sufficient for the cutlery item 7 to be discharged into the cutlery collection receptacle 9, before the flaps 6, 6' return to their normal position. The flap reversing movement may be achieved either by an unillustrated return spring or by reversing the movement of the drive means 10. When the flaps are in their first, normal or closed positions, the waste 17 is discharged down into the waste container 3 after sliding along the upper surfaces of the flaps 6.

In FIGS. 3–5 there is illustrated a second embodiment of an apparatus in accordance with the invention. Here, the glacis 2 is provided, starting immediately under its free end 5 and extending in the direction of waste movement, with two flaps 6, 6' mounted on hinges 26 for being swung to, and from each other between two end positions. The function of the arms 12, 13 guiding the flaps 6, 6' is the same as for the embodiment in the previous description, and thus this function does not need to be described again. In their normal positions the flaps 6, 6' form sliding surfaces having the form of an inverted V in cross section. The flaps 6, 6' have an elongate, rectangular shape, and along one long edge 21, 21' each is fastened to a hinge 26. The cutlery collection receptacle 9 is removably arranged centrally in the waste container 3, to extend right across it, such as to be easily lifted up when it is full of cutlery 7. At their short ends 23, 23' facing towards the arms 12, 13 the flaps 6, 6' have guide pins 24, 24' for connectable coaction with a gripping means 25, 25' on the respective arm 12, 13.

In their normal positions the flaps 6, 6' are in their closed positions with their long edges 19, 19' juxtaposed, and thus constitute a continuation of the web 2 for discharging waste down into the waste container without the waste coming into the cutlery collection receptacle 9. When a cutlery item 7 is sensed by one or more detectors 8, the flaps 6, 6' swing upwards and outwards to form a hopper-like opening 22 for catching and guiding the item(s) of cutlery down into the receptacle 9. As soon as the cutlery has fallen into the receptacle the flaps 6, 6' rapidly return to their starting or normal positions. A variant of this embodiment would be to have the flaps 6, 6' open in their first, normal positions and the waste container 3 situated in the position taken up by the receptacle 9 according to the drawings, the waste 17 then being collected via the hopper-like opening 22. Here, when a cutlery item 7 is sensed by one or more detectors 9 the flaps 6, 6' swing together into their closed positions and the cutlery is discharged down into the receptacle 9, which in this case is implemented such that it is situated outside the waste container 3, which is now smaller and centrally placed under the flaps 6, 6'.

As will be seen from the embodiment illustrated in FIGS. 3 and 4 the glacis 2 comprises two separate parts, namely an upper part 27 and a lower part 28 connected after it. These parts are removable and can be positionally fixed relative each other to facilitate cleaning them.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. Apparatus for separating cutlery from restaurant waste, the apparatus comprising:

a glacis for collecting the waste and causing it together with any cutlery to move in a direction towards an opening of a waste container which is supported by a stand and adapted so that the glacis is positionally adjustable at the opening of the waste container, at least two flaps fastened at, or immediately below an end of the glacis and extending towards the opening of the waste container, the flaps movable between a closed and open position, at least one detector positioned at the glacis to detect cutlery thereon and adapted to send a signal when an item of cutlery passes by the detector, drive means connected to the flaps and adapted to receive the signal from the detector for causing movement of the flaps between the closed and opened positions such that when no signal is detected, the flaps are in the closed position functioning as an extension of the glacis to discharge waste into the waste container, and when a signal is detected the flaps are moved apart in the open position for permitting the detected cutlery items to fall between the opened flaps into a cutlery collection receptacle, thereby the waste is separated from the cutlery, the glacis formed by both flaps for the discharge of waste has a cross section in the form of an inverted V, in their closed positions the flaps covering the opening of the cutlery collection receptacle, and being pivotably fixed along their long edges at the opening.

2. Apparatus as claimed in claim 1, wherein each flap has an elongate rectangular shape, the flaps being pivotable from their closed positions to their open positions where the flaps form a hopper-like opening above the cutlery collection receptacle for catching and guiding cutlery items into the cutlery collection receptacle.

3. Apparatus for separating cutlery from restaurant waste, the apparatus comprising:

a glacis for collecting the waste and causing it together with any cutlery to move in a direction towards an opening of a waste container which is supported by a stand and adapted so that the glacis is positionally adjustable at the opening of the waste container, at least two flaps fastened at, or immediately below an end of the glacis and extending towards the opening of the waste container, the flaps movable between a closed and open position, at least one detector positioned at the glacis to detect cutlery thereon and adapted to send a signal when an item of cutlery passes by the detector, drive means connected to the flaps and adapted to receive the signal from the detector for causing movement of the flaps between closed and opened positions such that when no signal is detected, the flaps are in the closed position functioning as an extension of the glacis to discharge waste into the waste container, and when a signal is detected the flaps are moved apart in the open position for permitting the detected cutlery items to fall between the opened flaps into a cutlery collection receptacle, thereby the waste is separated from the cutlery, the cutlery collection receptacle is removably arranged centrally in the waste container and extends across its opening, each of the flaps having at one of a shorter side thereof a guide pin for connectable coaction with a gripping means, and the gripping means being connected to a pivotable arm.

* * * * *